US009551533B2

(12) United States Patent
Maruyama et al.

(10) Patent No.: US 9,551,533 B2
(45) Date of Patent: Jan. 24, 2017

(54) HEAT EXCHANGER UNIT

(71) Applicant: Calsonic Kansei Corporation, Saitama (JP)

(72) Inventors: Tomohiro Maruyama, Saitama (JP); Toru Kawamata, Saitama (JP); Satoshi Kamimura, Saitama (JP)

(73) Assignee: Calsonic Kansei Corporation, Saitama (JP)

( * ) Notice: Subject to any disclaimer, the term of this patent is extended or adjusted under 35 U.S.C. 154(b) by 483 days.

(21) Appl. No.: 13/944,432

(22) Filed: Jul. 17, 2013

(65) Prior Publication Data

US 2014/0020865 A1 Jan. 23, 2014

(30) Foreign Application Priority Data

Jul. 17, 2012 (JP) ..... 2012-158942

(51) Int. Cl.
*F28D 1/04* (2006.01)
*F28D 1/03* (2006.01)
*F28D 1/053* (2006.01)

(52) U.S. Cl.
CPC ..... *F28D 1/0417* (2013.01); *F28D 1/0341* (2013.01); *F28D 1/0435* (2013.01); *F28D 1/05341* (2013.01); *F28F 2250/06* (2013.01)

(58) Field of Classification Search
CPC .... F28D 1/0341; F28D 1/0375; F28D 1/0383; F28D 1/0417; F28D 1/0435; F28D 1/05341; F28F 27/02; F28F 2250/06
USPC ..... 165/153
See application file for complete search history.

(56) References Cited

U.S. PATENT DOCUMENTS 5,701,760 A * 12/1997 Torigoe ..... F28D 1/0333 165/153
6,341,648 B1 * 1/2002 Fukuoka ..... B21C 37/0803 165/101
6,397,938 B1 * 6/2002 Nishishita ..... F28D 1/0341 165/153

(Continued)

FOREIGN PATENT DOCUMENTS

CN 1784576 6/2006
CN 101004301 7/2007

(Continued)

*Primary Examiner* — Tho V Duong
(74) *Attorney, Agent, or Firm* — Wenderoth, Lind & Ponack, L.L.P.

(57) ABSTRACT

A heat exchanger unit includes a heat exchanger main body in which a first heat exchanger and a second heat exchanger are arranged in series relative to a refrigerant flowing direction and an air flowing direction. The heat exchanger main body includes on one side thereof an external connection portion configured to supply at least refrigerant and on the other side thereof a communicating portion configured to connect (allowing fluid communication between) the first heat exchanger and the second heat exchanger. A bypass flow path extends from the one side to the other side of the heat exchanger main body, and is configured to bypass the first heat exchanger. At least one of the first heat exchanger and the second heat exchanger includes a pair of tank sections disposed at an interval, and a plurality of first heat transfer tubes configured to connect the pair of tank sections.

5 Claims, 6 Drawing Sheets

(56) References Cited

U.S. PATENT DOCUMENTS

| | | | | |
|---|---|---|---|---|
| 6,516,486 | B1 * | 2/2003 | Mehendale | F28D 1/0333 165/153 |
| 8,806,889 | B2 * | 8/2014 | Ota | F25B 39/022 62/500 |
| 2002/0079093 | A1 * | 6/2002 | Rong | F28D 1/0341 165/153 |
| 2004/0035564 | A1 * | 2/2004 | Park | F28D 1/0341 165/153 |
| 2006/0288733 | A1 | 12/2006 | Shinmura et al. | |
| 2007/0169511 | A1 | 7/2007 | Ishizaka et al. | |
| 2007/0169512 | A1 * | 7/2007 | Ishizaka | F25B 5/04 62/515 |
| 2008/0264097 | A1 * | 10/2008 | Ishizaka | F24F 3/153 62/500 |
| 2009/0090130 | A1 | 4/2009 | Aung et al. | |

FOREIGN PATENT DOCUMENTS

| | | |
|---|---|---|
| CN | 101636629 | 1/2010 |
| CN | 102563986 | 7/2012 |
| GB | 2 056 652 | 3/1981 |
| JP | 04-139364 | 5/1992 |
| JP | 10-038492 | 2/1998 |
| JP | 2000-105093 A | 4/2000 |
| JP | 2009-085569 A | 4/2009 |
| WO | 2008/110249 | 9/2008 |

* cited by examiner

HEAT EXCHANGER UNIT

PRIORITY CLAIM

The present application is based on and claims priority from Japanese Patent Application No. 2012-158942, filed on Jul. 17, 2012, the disclosure of which is hereby incorporated by reference in its entirety.

BACKGROUND

Field of the Invention

The present invention relates to a heat exchanger unit.

Description of the Related Art

A vehicle, for example, an automobile is provided with an air-conditioning device (hereinafter, referred to as an air conditioner) which adjusts the temperature in a vehicle.

Such an air conditioner includes a looped refrigerant flow path which circulates a refrigerant. A compressor, condenser, decompression mechanism (expansion valve or decompression valve), and heat exchanger are sequentially arranged in the refrigerant flow path to constitute a refrigerant cycle.

Of these, the heat exchanger is disposed inside an air conditioning unit provided in a vehicle (refer to Patent Document 1, JP 2009-85569A, for example).

The heat exchanger of Patent Document 1 includes a main body in which a first heat exchanger and a second heat exchanger are arranged side by side. The first heat exchanger includes on one side thereof a refrigerant entrance and on the other side thereof a refrigerant exit. The heat exchanger of Patent Document 1 is configured to supply the refrigerant from the refrigerant exit provided in the other side of the first heat exchanger and the refrigerant flowing in a bypass flow path to a refrigerant entrance provided in one side of the second heat exchanger.

However, the heat exchanger of Patent Document 1 has a problem in that the path of the refrigerant becomes complex because the refrigerant exit of the first heat exchanger and the refrigerant entrance of the second heat exchanger are located on sides opposite to each other in the main body.

On the other hand, there is a heat exchanger in which a refrigerant exit of a first heat exchanger and a refrigerant entrance of a second heat exchanger are disposed on the same side in a main body (refer to Patent Document 2, JP 2000-105093A, for example).

In the heat exchanger of Patent Document 2, a communicating path that provides communication between the refrigerant exit of the first heat exchanger and the refrigerant entrance of the second heat exchanger is provided in the outer surface of a side plate disposed outside the main body.

However, in the heat exchanger described in Patent Document 2, the communicating path that provides communication between the refrigerant exit of the first heat exchanger and the refrigerant entrance of the second heat exchanger is provided in the outer surface of the side plate disposed in the outermost side of the main body. For this reason, cold air from the refrigerant flowing in the communicating path flows to the outside, resulting in heat loss.

More specifically, the refrigerant flowing in the communicating path is wasted because it is used for cooling the main body (casing) of the air-conditioning unit, a seal member attached in the circumference of the heat exchanger, or the like without cooling air-conditioning air passing through the heat exchanger.

SUMMARY

In order to solve the above problem, one embodiment of the present invention provides a heat exchanger unit including: a heat exchanger main body in which a first and a second heat exchanger are arranged in series relative to a refrigerant flowing direction and an air flowing direction The heat exchanger main body includes on one side thereof an external connection portion configured to supply at least refrigerant, and on the other side thereof a communicating portion configured to communicate the first heat exchanger and the second heat exchanger. A bypass flow path extends from the one side to the other side of the heat exchanger main body, and is configured to bypass the first heat exchanger. At least one of the first heat exchanger and the second heat exchanger includes a pair of tank sections disposed at an interval, and a plurality of first heat transfer tubes configured to connect a pair of tank sections. The bypass flow path includes a bypass tube disposed along the tank section on the external connection portion side, and a second heat transfer tube in which the first heat transfer tube located near the communicating portion of the first heat exchanger or the second heat exchanger is partitioned from other portions of the first heat exchanger or the second heat exchanger.

BRIEF DESCRIPTION OF THE DRAWINGS

The accompanying drawings are included to provide further understanding of the present disclosure, and are incorporated in and constitute a part of this specification. The drawings illustrate embodiments of the present disclosure and, together with the specification, serve to explain the principle of the present disclosure.

DESCRIPTION OF THE PREFERRED EMBODIMENTS

Hereinafter, an embodiment of the present invention will be described with reference to the drawings.

FIGS. 1-9 are views illustrating the embodiment and a modified example thereof.

Embodiment

Hereinafter, the configuration will be described.

An air-conditioning device (hereinafter, referred to as air conditioner) which adjusts a temperature in a vehicle is provided in a vehicle, for example, an automobile.

Figure 1:
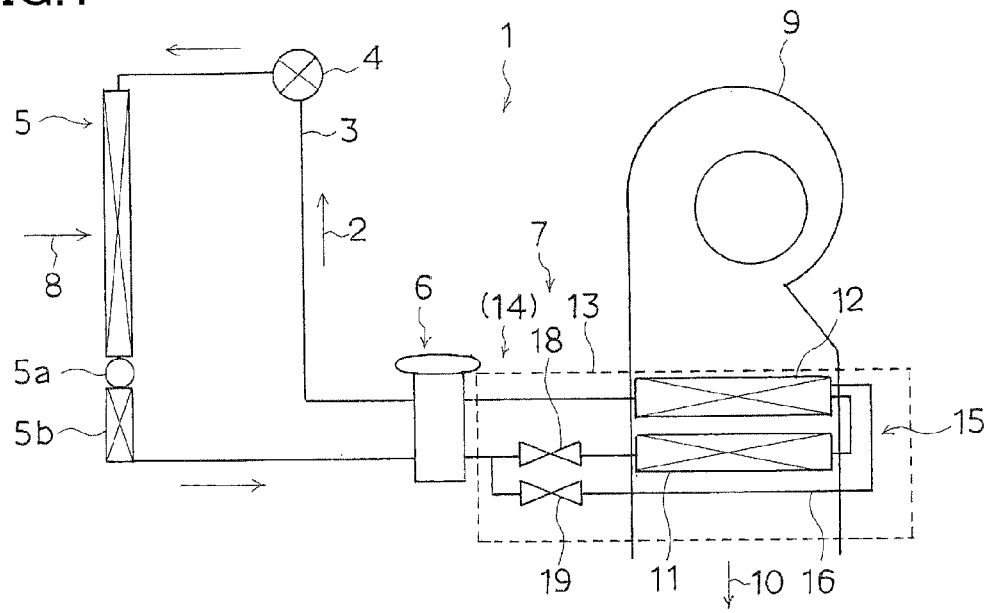
FIG. 1 is a schematic diagram illustrating an entire configuration of an air conditioner 1.

FIG. 1 is a schematic diagram illustrating the entire configuration of an air conditioner 1. The air conditioner 1 includes a looped refrigerant flow path 3 which circulates refrigerant 2 (cooling medium). A compressor 4, condenser 5, expansion valve 6 and heat exchanger 7 are sequentially arranged in the refrigerant flow path 3 to constitute a refrigerant cycle.

The above compressor 4 is a compressor which compresses the sucked refrigerant 2.

The condenser 5 is a condenser which condenses the refrigerant 2 after releasing the heat of the refrigerant 2 compressed by the compressor 4. The heat of the refrigerant 2 is discharged to external air 8 (traveling wind) which is introduced from the front portion of the vehicle by heat exchange.

The condenser 5 is provided with a tank 5*a* (receiver drier) which vapor-liquid separates the refrigerant 2 condensed by the condenser 5 and a supplemental condenser 5*b* (sub-condenser) which further condenses the refrigerant 2 liquefied by the tank 5*a*.

The expansion valve 6 is a decompression mechanism which decompresses the refrigerant 2 condensed by the condenser 5, and controls an exit temperature of the heat exchanger 7 by adjusting the flow volume (hereinafter, expansion valve includes decompression valve).

The heat exchanger 7 is a heat exchanger which evaporates the refrigerant 2 decompressed by a decompression mechanism, for example, the expansion valve 6. The heat exchanger 7 is disposed inside an air-conditioning unit 9 installed in a vehicle, and dehumidifies and cools air-conditioning air 10 by taking evaporative latent heat from the air-conditioning air 10 flowing in the air-conditioning unit 9.

Figure 2:
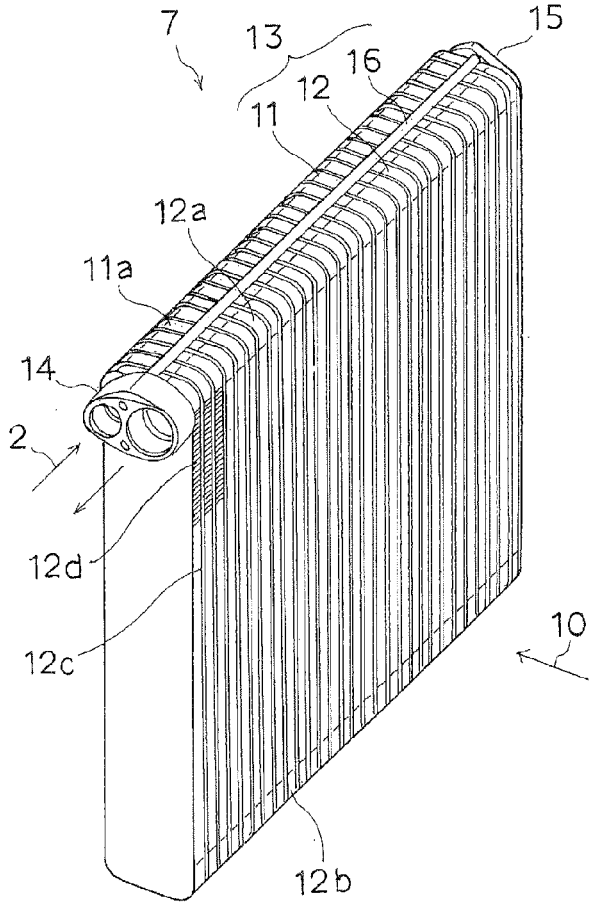
FIG. 2 is a perspective view of an entire heat exchanger.
Figure 3:
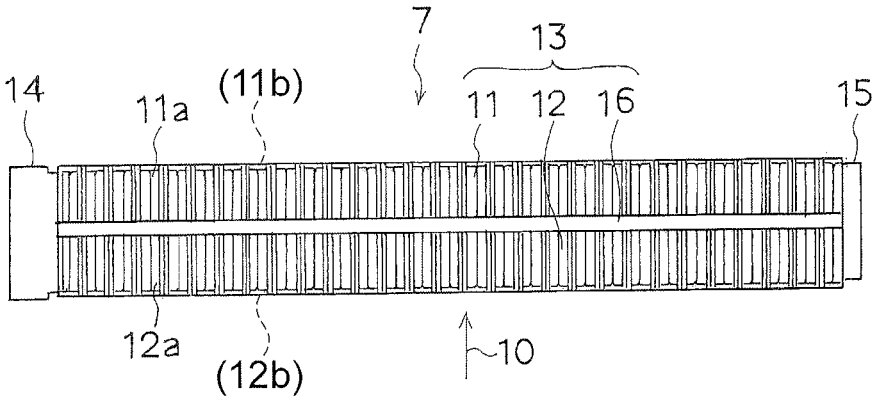
FIG. 3 is a plan view of FIG. 2.
Figure 4:
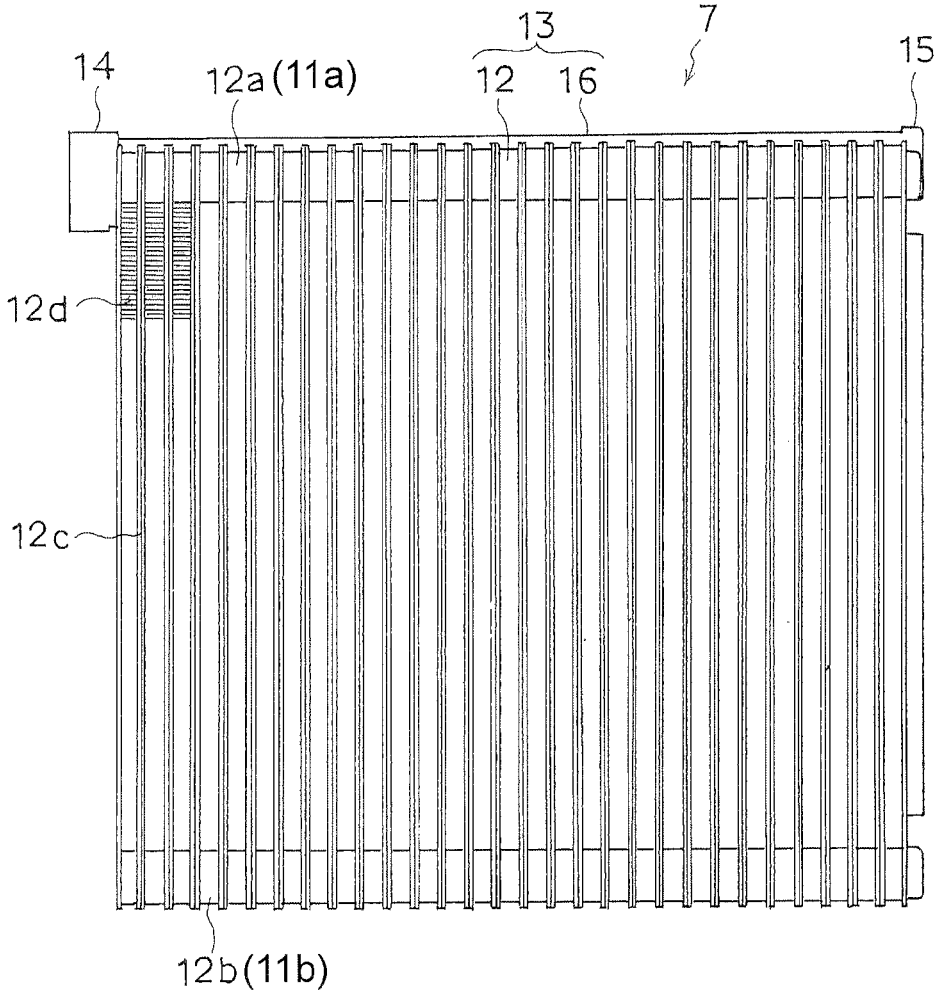
FIG. 4 is a side view of FIG. 2.

FIGS. 2-4 illustrate the specific configuration of the above-described heat exchanger 7.

The heat exchanger 7 includes a first heat exchanger 11 and a second heat exchanger 12. The first heat exchanger 11 and the second heat exchanger 12 are configured as an integrated heat exchanger main body 13. Both of the heat exchangers 11, 12 have approximately the same configuration.

Figure 5:
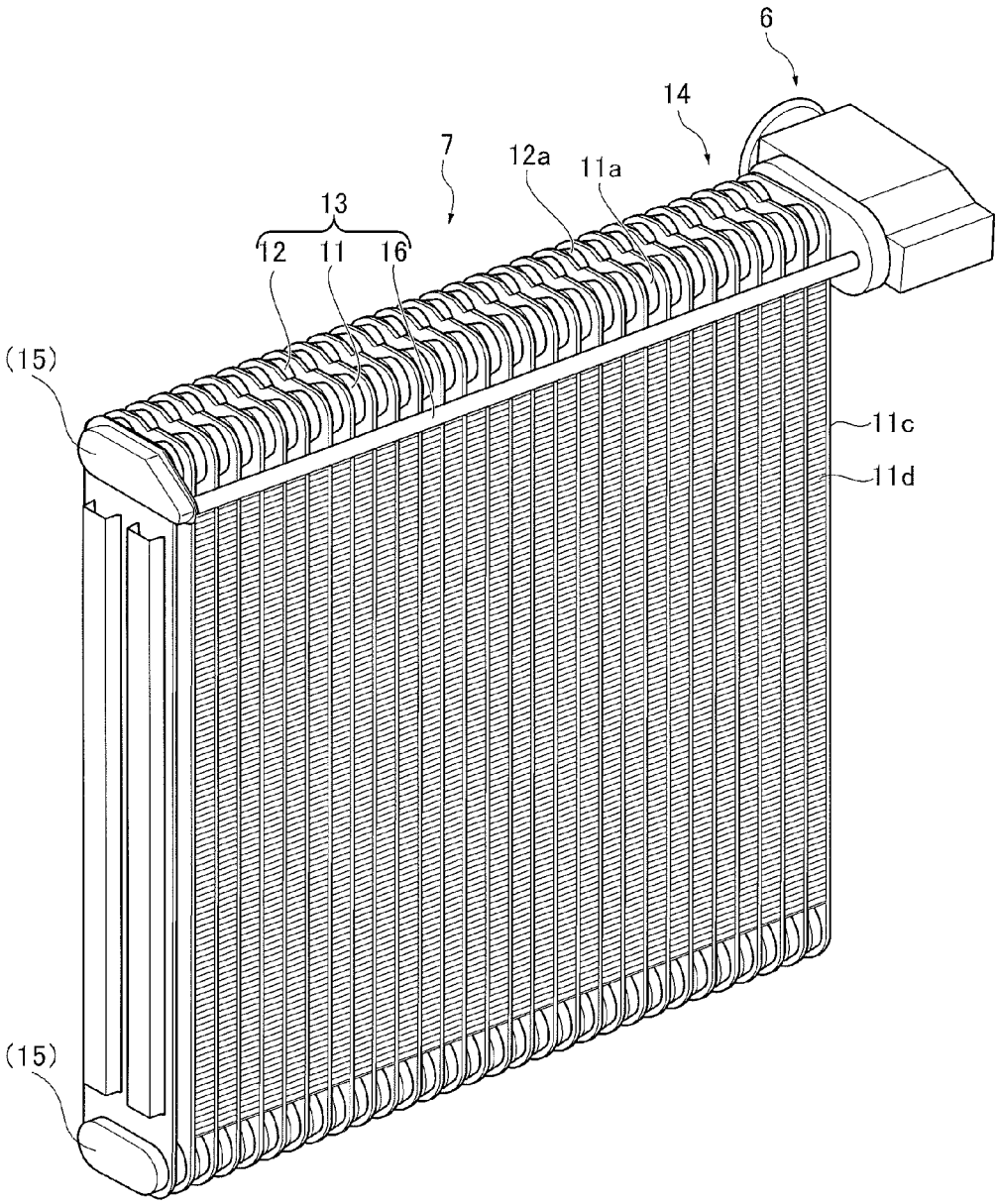
FIG. 5 is a perspective view of a heat exchanger as seen from a side opposite to that in FIG. 2.

Namely, as illustrated in FIGS. 4, 5, the first heat exchanger 11 includes a tubular upper tank 11 *a* and a tubular lower tank 11 *b* which are arranged up and down approximately parallel to each other, and a plurality of first heat transfer tubes 11*c* which extends in the up and down direction to allow the upper tank 11*a* to communicate with the lower tank 11*b*, and the second heat exchanger 12 includes a tubular upper tank 12*a* and a tubular lower tank 12*b* which are arranged up and down approximately parallel to each other, and a plurality of first heat transfer tubes 12*c* which extends in the up and down direction to allow the upper tank 12*a* to communicate with the lower tank 12*b*. With this configuration, the first heat exchanger 11 and the second heat exchanger 12 can be disposed to cover the air passage inside the air-conditioning unit 9 in a planar fashion or planar lattice fashion.

A plurality of first heat transfer tubes 11*c*, 12*c* are disposed approximately parallel to each other at intervals in the axis line direction of the upper tank 11*a*, 12*a* and the lower tank 11*b*, 12*b* such that the air-conditioning air 10 passes between the first heat transfer tubes 11*c*, 12*c*. Cooling fins 11*d*, 12*d* (refer to FIG. 5) which improve heat-exchange efficiency to the air-conditioning air 10 are attached between a plurality of first heat transfer tubes 11*c*, 12*c*.

FIG. 5 is a perspective view of the heat exchanger 7 as seen from the side opposite to that in FIG. 2 for describing a circumference of an external connection portion 14 of the heat exchanger 7. In addition, the position of a bypass flow path 16 differs between FIGS. 2-4 and 5. Namely, the bypass flow path 16 is disposed in the upper position between the upper tanks 11*a*, 12*a* in FIGS. 2-4, while the bypass flow path 16 is disposed outside the upper tank 11*a* of the first heat exchanger 11 in FIG. 5. Either configuration can be used.

In addition, the bypass flow path 16 uses a tube having inside thereof an orifice, for example, a capillary tube having a reduced diameter to have an effect which is the same as that of the orifice, or a tube in which these are combined.

Figure 6:
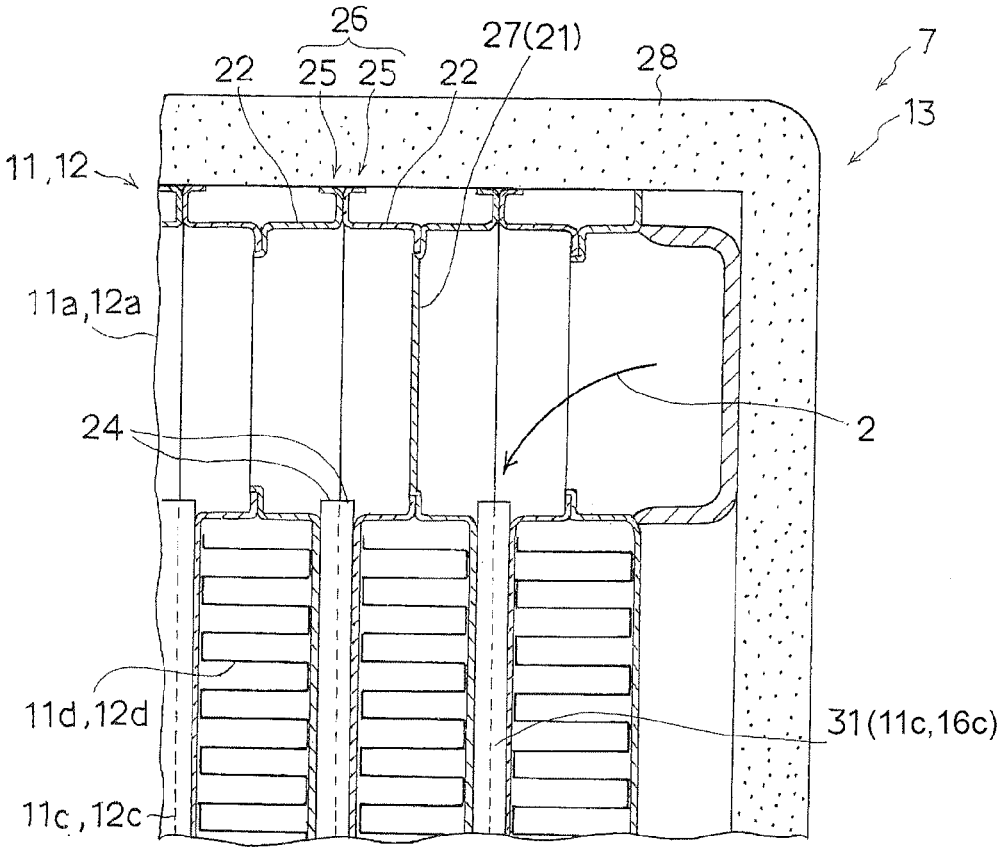
FIG. 6 is a partially enlarged schematic view of a drawn-cup type heat exchanger.

As illustrated in FIG. 6, the inside of the upper tank 11*a*, 12*a* and the inside of the lower tank 11*b*, 12*b* are divided into an arbitrary number of paths by a partition 21 in a lattice fashion to form a plurality of paths, so that the refrigerant 2 flows inside the first heat exchanger 11 and the second heat exchanger 12 while tuning up and down. The heat-exchange efficiency to the air-conditioning air 10 is therefore improved or adjusted.

Moreover, as illustrated in FIG. 6, such a heat exchanger 7 includes a drawn-cup type heat exchanger in which a plurality of unit modules 26 are laminated and fixed in the extending direction of the upper tank 11*a*, 12*a* and the lower tank 11*b*, 12*b*. The unit module 26 includes a pair of laminated plates 25 in each of which a metal plate having high heat conductivity such as aluminum is formed into a convex opening portion 22 (burring hole) constituting a part of the upper tank 11*a*, 12*a*, a not-shown convex opening portion (burring hole) constituting a part of the lower tank 11*b*, 12*b*, and a concave groove portion 24 constituting a part of the first heat transfer tube 11*c*, 12*c* connected by pressing. A pair of the laminated plates 25 is combined back-to-back (such that the first heat transfer tube 11*c*, 12*c* is formed between the concave groove portions 24.

In this case, the laminated plate 25 can form one or both of the first heat exchanger 11 and the second heat exchanger 12, and both of the first heat exchanger 11 and the second heat exchanger 12 are simultaneously formed.

In the drawn-cup type heat exchanger 7, the convex opening portion 22 is not provided in some area relative to the laminated plate 25 (convex closed portion 27 (emboss portion) is provided instated of convex opening portion 22), so that the partition 21 can be simply provided.

Figure 7:
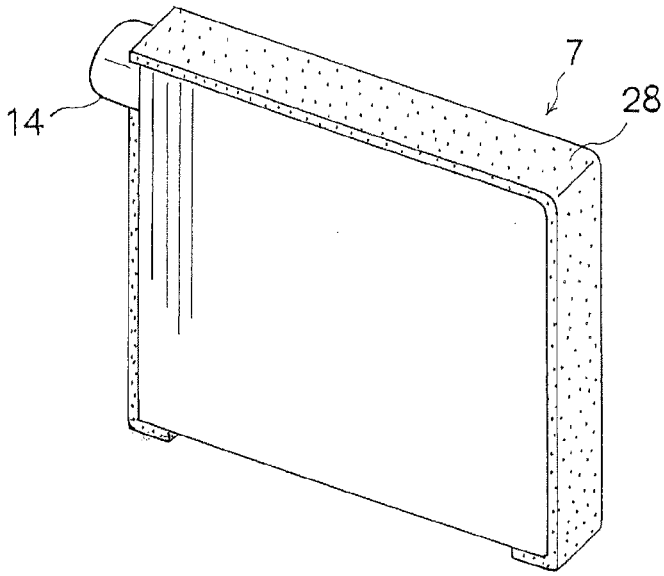
FIG. 7 is a perspective view of an entire heat exchanger to which a seal member is attached.

A seal member 28 is attached over the entire outer circumference portion of the heat exchanger 7 as illustrated in FIG. 7.

In this embodiment, the heat exchanger 7 includes the heat exchanger main body 13 in which the first heat exchanger 11 and the second heat exchanger 12 are arranged in series relative to the refrigerant flowing direction and the air flowing direction. The heat exchanger main body 13 includes on one side thereof the external connection portion 14 configured to supply at least the refrigerant 2 and on the other side thereof the communicating portion 15 configured to connect and allow the first heat exchanger 11 to communicate with the second heat exchanger 12. The bypass flow path 16 extends from a first side to a second side of the heat exchanger main body 13, configured to bypass the first heat exchanger. At least one of the first heat exchanger 11 and the second heat exchanger 12 includes a pair of tank sections (upper tank 11*a*, 12*a* and lower tank 11*b*, 12*b*) disposed at an interval, and a plurality of first heat transfer tubes 11*c*, 12*c* are configured to connect a pair of tank sections (upper tank 11*a*, 12*a* and lower tank 11*b*, 12*b*). This embodiment further includes the configuration as described below.

(Configuration 1)

Figure 8:
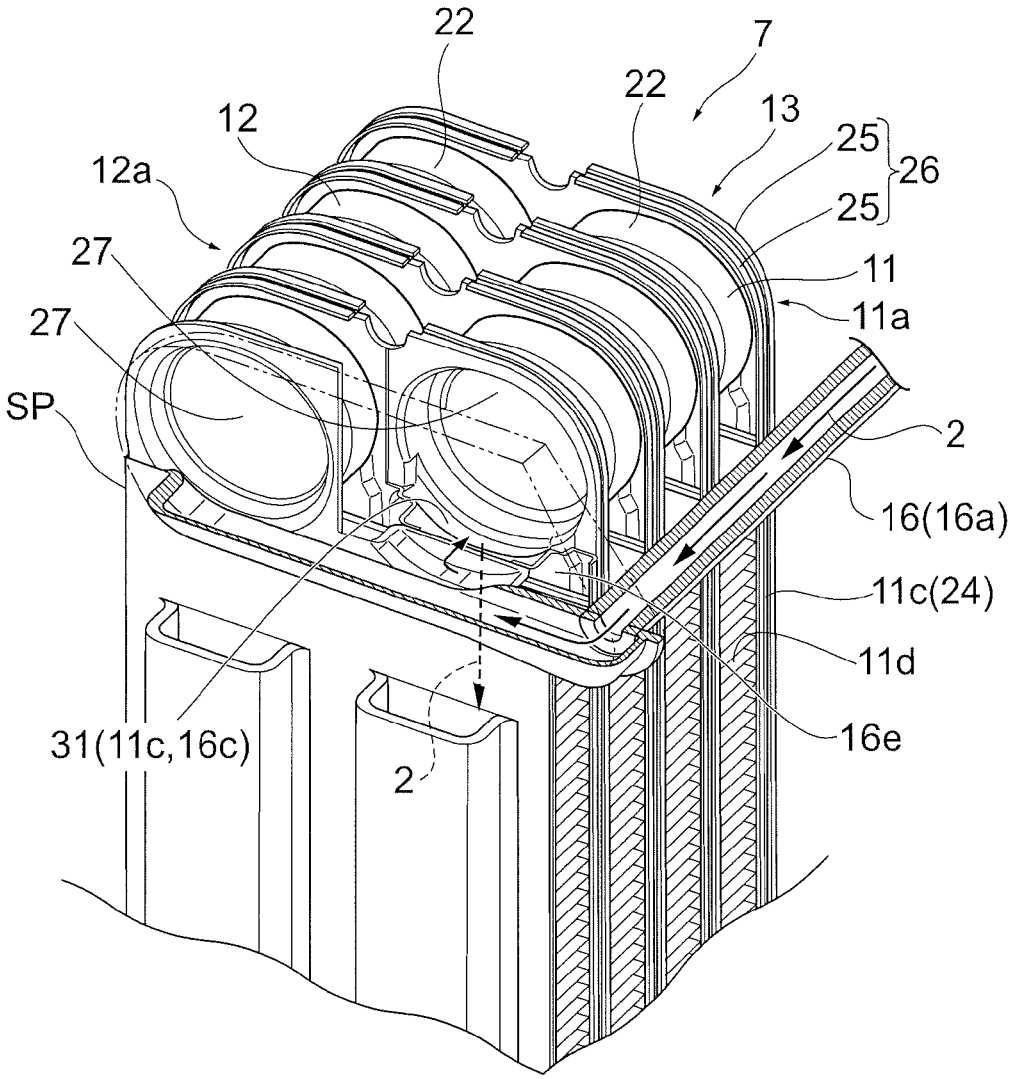
FIG. 8 is a partially enlarged schematic view illustrating a part of an embodiment of the present invention.

As illustrated in FIGS. 6, 8, the bypass flow path 16 includes a bypass tube 16*a* disposed along the tank section (upper tank 11*a*, 12*a*) on the external connection portion 14 side, and a second heat transfer tube 31 in which the first heat transfer tube 11*c*, 12*c* located near the communicating portion 15 of the first heat exchanger 11 or the second heat exchanger 12 is partitioned from other portions (for example, first heat transfer tube 11*c*, 12*c*) of the first heat exchanger 11 or the second heat exchanger 12.

(Supplemental Description 1)

In this case, each first heat transfer tube 11*c*, 12*c* extends to connect one tank section (for example, upper tank 11*a*, 12*a*) and the other tank section (for example, lower tank 11*b*, 12*b*) as an inside structure of the first heat exchanger 11 and the second heat exchanger 12.

The first heat transfer tube 11*c*, 12*c* located near the communicating portion 15 is the last heat transfer tube 11*c* (or several tubes around last tube) of the first heat exchanger 11 or the first heat transfer tube 12*c* (several tubes around first tube) of the second heat exchanger 12. In this case, the last heat transfer tube 11*c* (one tube) of the first heat exchanger 11 is used as the second heat transfer tube 31.

The second heat transfer tube 31 can be a heat transfer tube 11*c*, 12*c* of one or both of the first heat exchanger 11 and the second heat exchanger 12. In this case, only the heat transfer tube lie of the first heat exchanger 11 is used as the second heat transfer tube 31.

(Configuration 2)

When at least one of the first heat exchanger 11 and the second heat exchanger 12 includes a drawn-cup type heat exchanger in which a plurality of laminated plates 25 each having the convex opening portion 22 constituting a part of the tank section (upper tank 11*a*, 12*a* or lower tank 11*b*, 12*b*) and the concave groove portion 24 constituting a part of the heat transfer tube 11*c*, 12*c* is laminated and fixed, the second heat transfer tube 31 is partitioned from other portions (first heat transfer tube 11*c*, 12*c*) of the first heat exchanger 11 or the second heat exchanger 12 by forming the convex closed portion 27 (refer to FIG. 6) instead of the convex opening portion 22.

(Supplemental Description 2)

In this case, in FIG. 8, the second heat transfer tube 31 is formed by dividing the upper tank 11*a* of the first heat exchanger 11 to partition the last heat transfer tube 11*c*. However, for example, the second heat transfer tube 31 can be formed by dividing the upper tank 12*a* of the second heat exchanger 12 to partition the first heat transfer tube 12*c*. Both of the last heat transfer tube 11*c* of the upper tank 11*a* of the first heat exchanger 11 and the first heat transfer tube 12*c* of the upper tank 12*a* of the second heat exchanger 12 can be partitioned to be the second heat transfer tube 31.

In FIG. 8, a relay member 16*e* which connects the bypass tube 16*a* of the bypass flow path 16 and the second heat transfer tube 31 is disposed outside the outer surface (side plate SP) of the other side of the first heat exchanger 11. In addition, when the second heat transfer tube 31 is provided on the second heat exchanger 12 side, the relay member 16*e* extends to the second heat exchanger 12 along the outer surface (side plate SP).

Figure 9:
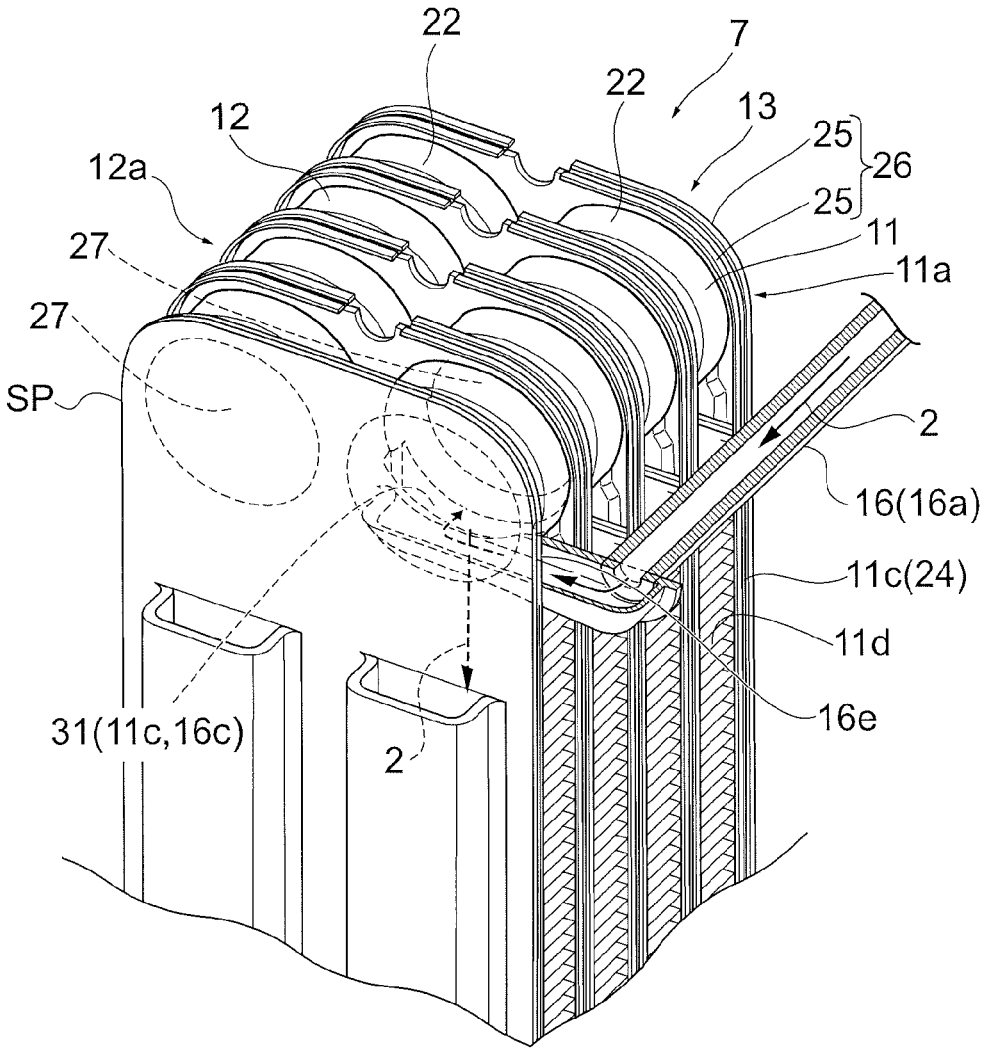
FIG. 9 is a partially enlarged schematic view illustrating a part of a modified example of the embodiment in FIG. 8.

As illustrated in FIG. 9, the relay member 16*e* can be disposed inside the outer surface (side plate SP).

For example, when the bypass tube 16*a* of the bypass flow path 16 is disposed along the lower tank 11*b*, 12*b* of the first heat exchanger 11 or the second heat exchanger 12, the second heat transfer tube 31 can be provided similar to the above by dividing the lower tank 11*b*, 12*b* of the first heat exchanger 11 or the second heat exchanger 12.

(Configuration 3)

The external connection portion 14 and the communicating portion 15 are disposed on one tank section (upper tank 11*a*, 12*a* or lower tank 11*b*, 12*b*) side and the other tank section (lower tank 11*b*, 12*b* or upper tank 11*a*, 12*a*) side of a pair of tank sections (upper tank 11*a*, 12*a* and lower tank 11*b*, 12*b*), respectively.

(Supplemental Description 3)

For example, the external connection portion 4 is disposed on the upper tank 11*a*, 12*a* side, and the communicating portion 15 is disposed on the lower tank 11*b*, 12*b* section.

The external connection portion 14 can be disposed on the lower tank 11*b*, 12*b* side and the communicating portion 15 can be disposed on the upper tank 11*a*, 12*a* side.

In this case, the communicating portion 15 can be provided outside the outer surface (side plate SP) of the heat exchanger main body 13 (refer to FIG. 8) or can be provided inside the outer surface (side plate SP) of the heat exchanger main body 13. When the communicating portion 15 is provided inside the outer surface (side plate SP) of the heat exchanger main body 13, a communicating path which connects the tank sections (upper tanks 11*a*, 12*a* or lower tank 11*b*, 12*b*) is formed in the laminated plate 25.

(Configuration 4)

The external connection portion 14 and the communicating portion 15 are disposed on one tank section (upper tank 11*a*, 12*a* or lower tank 11*b*, 12*b*) side of a pair of tank sections (upper tank 11*a*, 12*a* and lower tank 11*b*, 12*b*).

(Supplemental Description 4)

For example, both of the external connection portion 14 and the communicating portion 15 are disposed on the upper tank 11*a*, 12*a* side.

Both of the outer connection portion 14 and the communicating portion 15 can be disposed on the lower tank 11*b*, 12*b* side.

In this case, the communicating portion 15 is provided between the tank sections (upper tanks 11*a*, 12*a* or lower tanks 11*b*, 12*b*) which directly communicate with the first heat transfer tube 11*c*, 12*c* inside the outer surface (side plate SP) of the heat exchanger main body 13 because the second heat transfer tube 31 is the bypass flow path 16.

The bypass flow path 16 is connected to the portion on the more downstream side or the more upstream side than the communicating portion 15 on the other tank section (lower tank 11*b*, 12*b* or the upper tank 11*a*, 12*a*).

(Configuration 5)

The first heat transfer tube 11*c*, 12*c* and the second heat transfer tube 31 include the same sectional shape.

(Supplemental Description 5)

In this case, both of the first and second heat transfer tubes can have the same sectional shape by forming the second heat transfer tube 31 by using a part of the first heat transfer tube 11*c*, 12*c*.

(Configuration 6)

The second heat transfer tube 31 is disposed in a heat exchanger located on the leeward side in the first heat exchanger 11 and the second heat exchanger 12.

(Supplemental Description 6)

In this case, the second heat transfer tube 31 is disposed on the first heat exchanger 11 side as the leeward side.

In the above configuration, the tank section is the upper and lower tank sections (the upper tank 11*a*, 12*a* or lower tank 11*b*, 12*b*), but the tank section can be right and left tank sections, for example.

Hereinafter, the function of this embodiment will be described.

In the bypass flow path 16, the refrigerant 2 flows from one side to the other side of the heat exchanger main body 13 through the bypass tube 16*a* disposed along the tank section (for example, upper tank 11*a*, 12*a*) on the external connection portion 14 side, and flows on the tank section (lower tank 11*b*, 12*b*) side (lower side) provided with the communicating portion 15 from the tank section (upper tank 11*a*, 12*a*) side (upper side) provided with the external connection portion 14 through the second heat transfer tube 31 inside the first heat exchanger 11 or the second heat exchanger 12.

According to the above embodiment, the following effects can be obtained.

(Functional Effect 1)

The external connection portion 14 and the communicating portion 15 are disposed in one tank section (for example, upper tank 11*a*, 12*a*) side and the other tank section (for example, lower tank 11*b*, 12*b*) side of a pair of tank sections (upper tank 11*a*, 12*a* and lower tank 11*b*, 12*b*), and the bypass flow path 16 includes the bypass tube 16*a* disposed along the tank section (upper tank 11*a*, 12*a*) on the external connection portion 14 side and the second heat transfer tube 31 in which the first heat transfer tube 11*c*, 12*c* located near the communicating portion 15 of the first heat exchanger 11 or the second heat exchanger 12 is partitioned from other portions of the first heat exchanger 11 or the second heat exchanger 12. With this configuration, the following effect can be obtained.

Namely, a circulating portion 16*c* of the last half of the bypass flow path 16 is constituted by the second heat transfer tube 31 provided inside the first heat exchanger 11 or the second heat exchanger 12, so that it becomes unnecessary to dispose the circulating portion 16*c* of the last half of the bypass flow path 16 along the outer circumference of the heat exchanger main body 13. Thus, the configuration of the heat exchanger main body 13 can be simplified.

It becomes unnecessary to dispose the circulating portion 16*c* of the last half of the bypass flow path 16 along the outer circumference of the heat exchanger main body 13. Thus, the cooling air hardly flows outside from the circulating portion 16*c* of the bypass flow path 16, and the generation of heat loss can be controlled.

More specifically, the cooling air of the refrigerant 2 flowing in the circulating portion 16*c* of the bypass flow path 16 can be used for cooling the air-conditioning air 10 without using the cooling air for cooling the seal member 28 or the like attached around the air-conditioning unit 9 and the heat exchanger 7.

(Functional Effect 2)

At least one of the first heat exchanger 11 and the second heat exchanger 12 is a drawn-cup type heat exchanger in which a plurality of laminated plates 25 each of which having the convex opening portion 22 constituting a part of the tank section (upper tank 11*a*, 12*a* or lower tank 11*b*, 12*b*) and the concave groove section 24 constituting a part of the first heat transfer tube 11*c*, 12*c* is laminated and fixed. The second heat transfer tube 31 is portioned from other portions of the first heat exchanger 11 or the second heat exchanger 12 by forming the convex closed portion 27 in the laminated plate 25 instead of the convex opening portion 22. With this configuration, the second heat transfer tube 31 can be easily formed inside the first heat exchanger 11 or the second heat exchanger 12 without changing its basic configuration.

(Functional Effect 3)

The outer connection portion 14 and the communicating portion 15 can be disposed in one tank section (for example, upper tank 11*a*, 12*a*) side and the other tank section (for example, lower tank 11*b*, 12*b*) side of a pair of tank sections (upper tank 11*a*, 12*a* or lower tank 11*b*, 12*b*), respectively.

(Functional Effect 4)

The external connection portion 14 and the communicating portion 15 can be disposed in one tank section (for example, upper tank 11*a*, 12*a*) side of a pair of tank sections (for example, upper tank 11*a*, 12*a* or lower tank 11*b*, 12).

(Functional Effect 5)

The first heat transfer tube 11*c*, 12*c* and the second heat transfer tube 31 have the same sectional shape, so that it becomes unnecessary to set a flow path designed only for the second heat transfer tube 31.

(Functional Effect 6)

The second heat transfer tube 31 is installed in the heat exchanger located on the leeward side of the first heat exchanger 11 and the second heat exchanger 21, so that the cooling efficiency by the refrigerant flowing in the second heat transfer tube 31 can be improved.

Although the embodiments of the present disclosure have been described above, the present disclosure is not limited thereto. It should be appreciated that variations may be made in the embodiments described by persons skilled in the art without departing from the scope of the present disclosure. When each embodiment includes a plurality of configurations, for example, it should be obvious that the embodiment includes possible combinations of these configurations even if it is not explicitly described. When a plurality of embodiments and modified examples are illustrated, it should be obvious that they include possible combinations in these embodiments and examples even if it is not explicitly described. The configurations illustrated in the drawings are included even if they are not explicitly described. Moreover, the terms, for example, "or the like" or "for example" are used to include a commonly recognized scope or accuracy.

What is claimed is:

1. A heat exchanger unit comprising:

a heat exchanger main body including:

a first heat exchanger;

a second heat exchanger arranged in series with the first heat exchanger relative to a refrigerant flowing direction and an air flowing direction;

an external connection portion on a first side of the heat exchanger main body, the external connection portion being configured to supply refrigerant;

a communicating portion on a second side of the heat exchanger main body, the communicating portion being configured to connect the first heat exchanger and the second heat exchanger so as to allow the first heat exchanger and the second heat exchanger to communicate with each other; and a bypass flow path extending from the first side of the heat exchanger main body to the second side of the heat exchanger main body, the bypass flow path being configured to bypass the first heat exchanger so to supply the refrigerant from the external connection portion directly to the second heat exchanger;

wherein at least one of the first heat exchanger and the second heat exchanger includes a pair of tank sections spaced apart at an interval, and a plurality of first heat transfer tubes configured to connect the pair of tank sections, wherein the bypass flow path includes a bypass tube disposed along at least one of the pair of tank sections on the first side of the heat exchanger main body, and the bypass flow path further includes a second heat transfer tube formed of a heat transfer tube located at the communicating portion of the first heat exchanger or the second heat exchanger partitioned from other portions of the first heat exchanger or the second heat exchanger, and wherein the external connection portion and the communicating portion are disposed on the first tank section side and the second tank section side of a pair of the tank sections, respectively.

2. The heat exchanger unit according to claim 1, wherein at least one of the first heat exchanger and the second heat exchanger is a drawn-cup type heat exchanger including plurality of laminated plates, all but one of the plurality of laminated plates including a convex opening portion constituting a part of the tank section and a concave groove portion constituting a part of the first heat transfer tube, the plurality of laminated plates being laminated and fixed, and wherein the second heat transfer tube is partitioned from the other portions of the first heat exchanger or the second heat exchanger by forming a convex closed portion in one of the laminated plates instead of the convex opening portion.

3. The heat exchanger unit according to claim 1, wherein the external connection portion and the communicating portion are disposed on the first tank section side of a pair of the tank sections.

4. The heat exchanger unit according to claim 1, wherein the first heat transfer tube and the second heat transfer tube have the same cross-sectional shape.

5. The heat exchanger unit according to claim 1, wherein the second heat transfer tube is installed in the first heat exchanger or in the second heat exchanger, the second heat exchanger being located on a leeward side of the heat exchange unit.

* * * * *